US006619656B2

(12) United States Patent
Guddanti et al.

(10) Patent No.: US 6,619,656 B2
(45) Date of Patent: Sep. 16, 2003

(54) PAPER TRAY WITH AUTOMATICALLY ADJUSTING GUIDES

(75) Inventors: Srinivas Guddanti, Boise, ID (US); Chet M. Butikofer, Meridian, ID (US)

(73) Assignee: Hewlett-Packard Company, L.P., Houston, TX (US)

( * ) Notice: Subject to any disclaimer, the term of this patent is extended or adjusted under 35 U.S.C. 154(b) by 105 days.

(21) Appl. No.: 10/057,017

(22) Filed: Jan. 25, 2002

(65) Prior Publication Data

US 2003/0141652 A1 Jul. 31, 2003

(51) Int. Cl.[7] ..... B65H 1/00
(52) U.S. Cl. ..... 271/171
(58) Field of Search ..... 271/171, 144, 271/223; B65H 1/00, 31/20

(56) References Cited

U.S. PATENT DOCUMENTS 5,110,106 A 5/1992 Matsumura et al.
5,360,207 A 11/1994 Rauen et al.
5,573,236 A * 11/1996 Petocchi et al. ..... 271/265.02
5,574,551 A * 11/1996 Kazakoff ..... 399/45
5,847,405 A * 12/1998 Acquaviva et al. .... 250/559.36

FOREIGN PATENT DOCUMENTS

JP 4-705040 * 3/1992 ..... G01B/11/02
JP 7-2369 * 1/1995 ..... B65H/1/00
JP 10-212037 * 8/1998 ..... B65H/1/00
JP 2001-302030 * 10/2001 ..... B65H/11/00

* cited by examiner

*Primary Examiner*—Donald P. Walsh
*Assistant Examiner*—Kenneth W Bower

(57) ABSTRACT

A paper tray automatically adjusts to accommodate a variety of media sizes. An array of photodetectors on the support surface of the tray are masked from light by placing media in the tray. A controller determines the size of the media by monitoring which photodetectors have been masked. The controller can then direct tray guides to move to predetermined positions corresponding to the size of the media.

17 Claims, 5 Drawing Sheets

PAPER TRAY WITH AUTOMATICALLY ADJUSTING GUIDES

BACKGROUND OF THE INVENTION

1. Field of the Invention

The present invention relates generally to the field of paper trays for printers, copies, and the like. More specifically, the present invention discloses a paper tray with tray guides that automatically adjust to accommodate a range of media sizes.

2. Statement of the Problem

Many sheet-fed devices, such as printers, scanners, copiers, fax machines, and the like, must accommodate a variety of different media sizes. The conventional approach has been to equip these devices with a paper tray having movable tray guides that can be manually adjusted by the user for different media sizes.

The prior art in this field also includes several patents that disclose paper trays that automatically adjust the positions of the tray guides to accommodate different media sizes. For example, U.S. Pat. No. 5,360,207 (Rauen et al.) and U.S. Pat. No. 5,110,106 (Matsumura et al.) disclose automatically-adjusting paper trays that use pressure transducers to sense when the guides are brought into contact with the edges of the media stack. However, this approach has a basic limitation in that a short stack of paper containing only a few sheets may not be sufficient to trigger the pressure sensors on the tray guides. Instead, the media will tend to bow or distort, thereby creating the risk of a paper jam or a misfeed. Therefore, a need continues to exist for an automatically-adjusting paper tray capable of handling a wide variety of media sizes and stacks of any thickness.

3. Solution to the Problem

None of the prior art references discussed above show an automatically-adjusting paper tray that employs arrays of photodetectors on the floor of the paper tray to sense the edges of the media.

SUMMARY OF THE INVENTION

This invention provides a paper tray that automatically adjusts to accommodate a variety of media sizes. An array of photodetectors on the support surface of the tray are masked from light by placing media in the tray. A controller determines the size of the media by monitoring which photodetectors have been masked. The controller can then direct tray guides to move to predetermined positions corresponding to the dimensions of the media.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
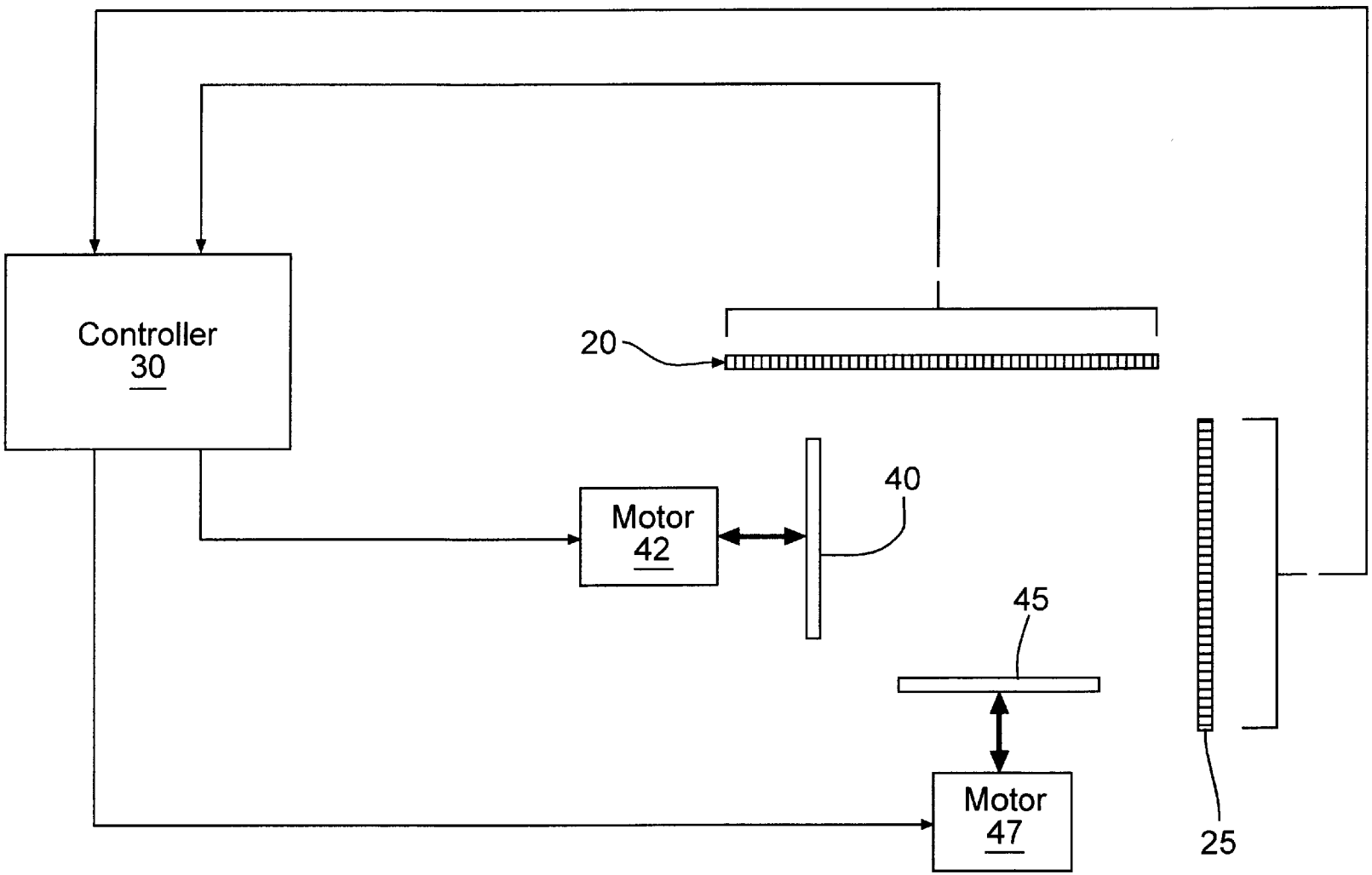
FIG. 1 is a schematic block diagram of a paper tray 10 incorporating the present invention.
Figure 2:
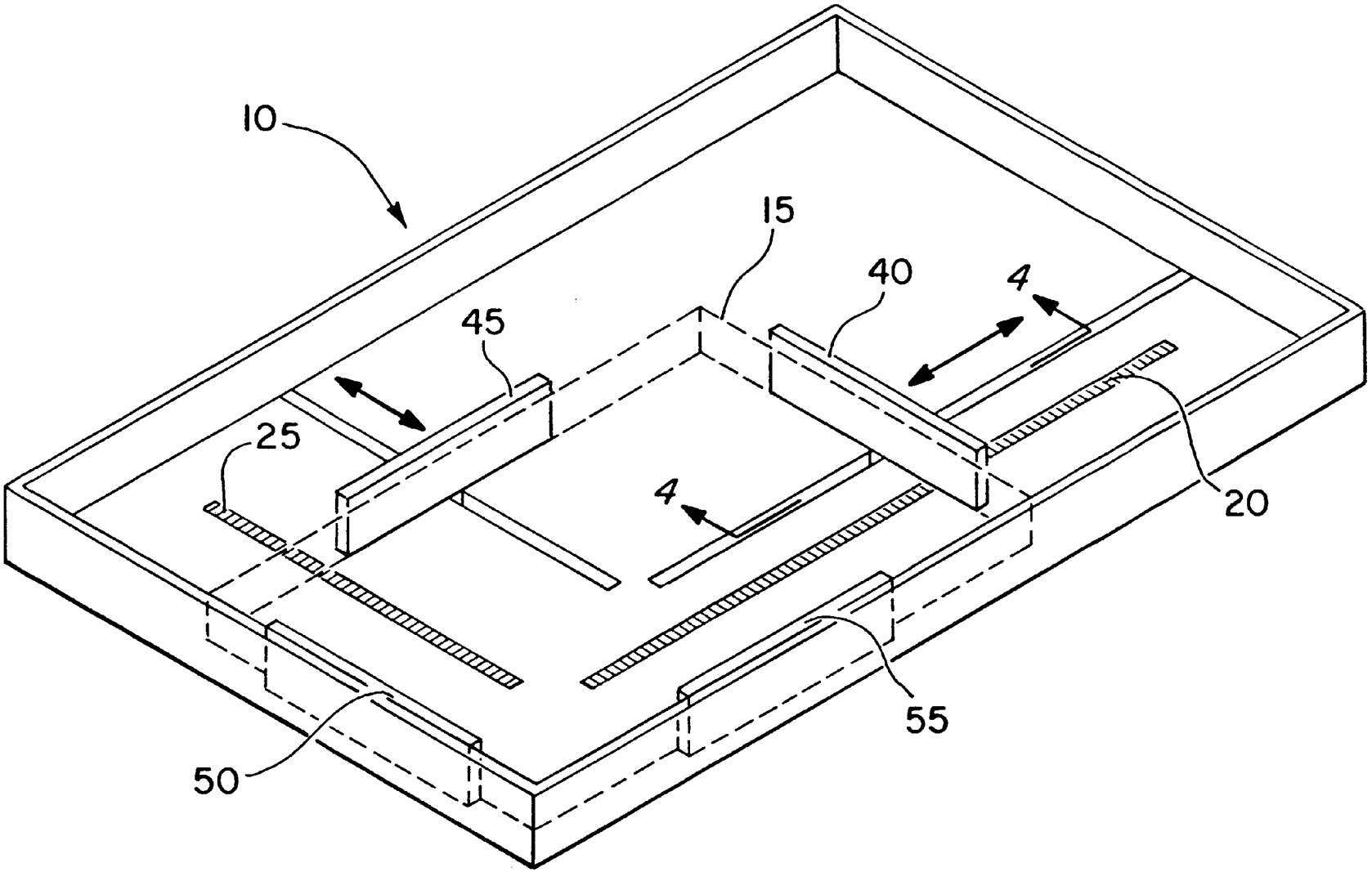
FIG. 2 is a top perspective view of a paper tray 10 incorporating the present invention.
Figure 3:
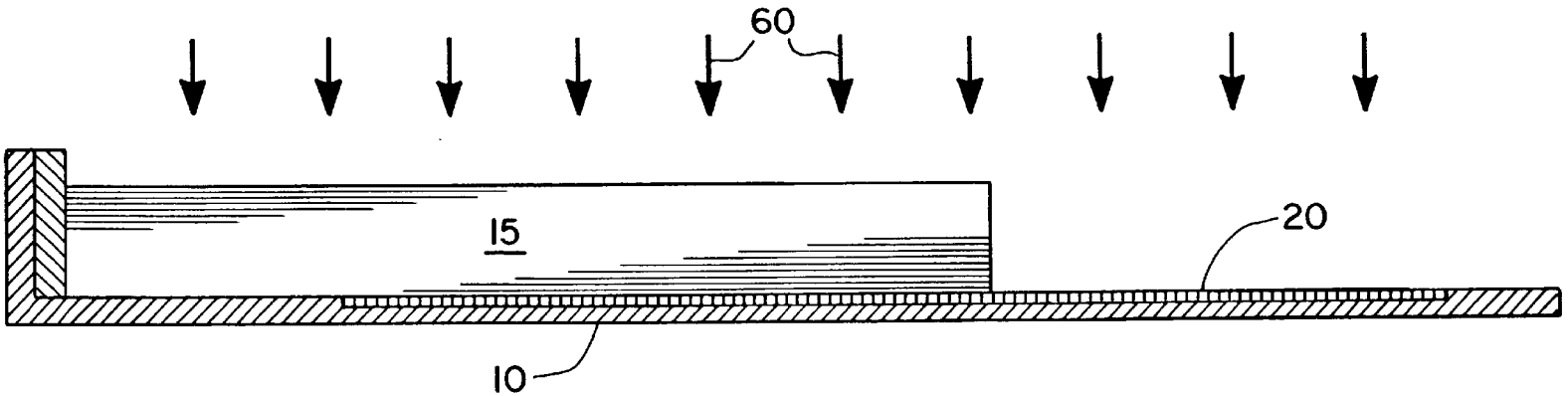
FIG. 3 is a vertical cross-sectional view of the paper tray 10 corresponding to FIG. 2.

Turning to FIG. 1, a schematic block diagram of the present invention is provided. FIG. 2 is a top perspective view of a paper tray 10 incorporating the present invention and FIG. 3 is a corresponding vertical cross-sectional view of the paper tray 10. The paper tray 10 includes a support surface for holding a stack 15 of paper, transparencies, envelopes, labels, or sheets of similar material to be processed. The size of the media 15 can vary widely. For example, conventional computer printers are typically capable of handling letter, legal, and A4 paper sizes, as well as a range of envelope and label sizes. It should also be understood that the present invention could be used in association with a wide variety of sheet-fed devices, including printers, copiers, fax machines, scanners and the like. For the purposes of this patent application, all types of paper, envelopes, transparencies, labels, and other types of materials capable of being processed by such sheet-fed devices should be considered as being "media."

A number of arrays of photodetectors extend across the support surface of the tray 10. FIGS. 1 and 2 illustrate an embodiment of the present invention using two orthogonal arrays of photodetectors 20 and 25. The first array of photodetectors 20 extend parallel to the long edge of the media 15 and are used to determine the length of the media 15. In contrast, a second array of photodetectors 25 extend parallel to the short edge of the media 15 and are used to determine the width of the media 15. In the embodiment shown in FIGS. 1 and 2, a portion of each photodetector array 20, 25 underlies the media 15 and is masked from exposure to light, as illustrated in FIG. 3. The remaining photodetectors in each array 20, 25 extend beyond the edge of the media so that they remain exposed to light. The exposed photodetectors can be illuminated by means of a light source 60 (e.g., an incandescent or fluorescent light bulb, or light-emitting diodes) placed within the paper tray or on the device above the paper tray. The visible spectrum of light is acceptable. However, an infrared light source can be used to lessen the aesthetic impact of the present invention. Alternatively, the photodetector arrays can rely on ambient light for illumination of those photodetectors that are not masked by the media 15 in the paper tray 10.

It should be expressly understood that any of a variety of photodetectors can be used to create the photodetector arrays 20 and 25. For example, the photodetectors can be photocells that generate an output voltage that is a function of the intensity of the incident light. Alternatively, each photodetector can be a photoresistor that changes its resistance as a function of the intensity of the incident light.

A controller 30 (e.g., a microprocessor) monitors each of the photodetectors to determine which of the photodetectors have been masked by the media 15 stacked in the paper tray 10. For example, if a photodetector array 20, 25 consists of 100 photodetectors, the controller might find in a given instance that the first eighty photodetectors have been masked by the media 15, but the last twenty photodetectors are still being illuminated. If the media stack 15 has not been placed quite correctly into the tray 10, the first five and the last fifteen photodetectors might be illuminated, while the intermediate eighty photodetectors remain masked. In either case, the controller can readily determine the dimension of the media 15 parallel to the axis of the photodetector array based on the number of photodetector elements that are masked by the media 15 in the tray 10. This can be programmed into the controller as a simple look-up table that correlates the number of masked photodetectors in an array 20 or 25 to a corresponding media dimension. If two orthogonal arrays of photodetectors 20 and 25 are used to measure the length and width of the media 15, a two-dimensional look-up table can be used to correlate the numbers of masked photodetectors in both arrays 20 and 25 to a specific media size (e.g., letter, legal, or A4 paper) and media orientation (e.g., portrait or landscape mode). Since there are only relatively small number of valid dimensional combinations in common use, the look-up table can also flag invalid readings.

The controller 30 can be programmed to associate a small range of values in the number of masked photodetectors with each media size due, for example, to the limited resolution of the photodetector arrays, sloppiness in stacking the media, or an angled media stack. However, such tolerances should still enable the controller 30 to identify and distinguish between the media sizes in common use. The controller can also be programmed to ignore nonconsecutive or isolated masked photodetectors to compense for defective photodetectors or stray obstructions that might accidentally mask a photodetector.

In the preferred embodiment of the present invention, the controller 30 is the same processor that controls overall operation of the sheet-fed device. Alternatively, the controller 30 can be a separate controller dedicated to the paper tray. In either case, the page-size information generated by the controller 30 can be shared with any other controllers or computers associated with the sheet-fed device. For many types of sheet-fed devices, particularly printers and copiers, such page-size information can be useful in selecting the appropriate page setup for a particular job.

The embodiment of the present invention shown in FIG. 2 includes four tray guides 40, 45, 50, and 55 to support the four lateral edges of the stacked media 15 placed in the paper tray 10. Of these, the first and second tray guides 40 and 45 are orthogonal to one another and are movable along orthogonal axes by motors 42 and 47, respectively, controlled by the controller 30. The third and fourth tray guides 50 and 55 are orthogonal to one another, but are stationary relative to the paper tray.

Figure 4:
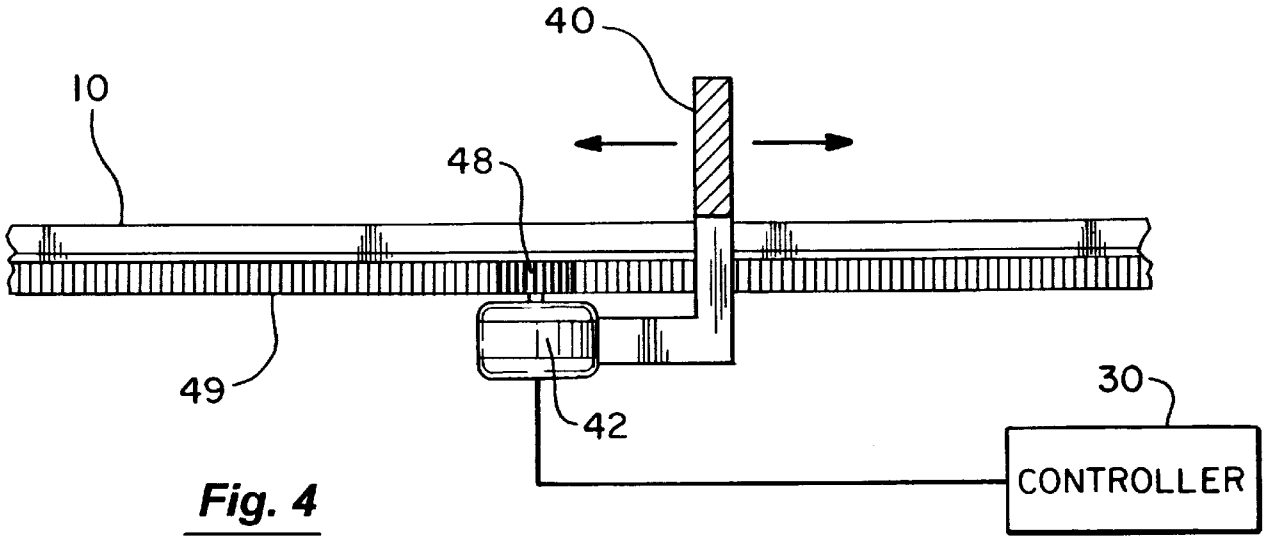
FIG. 4 is a detail side cross-sectional view of the motor and drive mechanism for a movable tray guide.

FIG. 4 is a detail side cross-sectional view of the motor 42 and drive mechanism for a movable tray guide 40. The tray guide 40 is constrained to slide along a slot in the floor of the paper tray 10. An electric motor 42 controlled by the controller 30 and mounted to the lower portion of the tray guide drives a pinion gear 48 that engages a rack gear 49 extending beneath the slot in the paper tray 10. Other types of drive mechanisms could be readily substituted for the rack and pinion gears.

The tray guides 40, 45, 50, and 55 define an rectangular region on surface of the paper tray for holding the stack of media 15. The dimensions of this rectangular region are controlled by the positions of the movable tray guides 40 and 45. The photodetector arrays 20 and 25 extend within the rectangular region bounded by the tray guides 40, 45, 50, and 55, so that at least a portion of each photodetector array 20, 25 will be masked by media stacked in the tray 10. In the embodiment shown in FIGS. 1 and 2, the first photodetector array 20 is aligned perpendicular to the first and third tray guides 40, 50 and parallel to the second and fourth tray guides 45, 55. The second photodetector array 25 is orthogonal to the first array 20, and thus is aligned parallel to the first and third tray guides 40, 50 and perpendicular to the second and fourth tray guides 45, 55.

It should be understood that other configurations of stationary and movable tray guides could be readily substituted. For example, the design of the paper tray 10 could be simplified to include only one movable tray guide, if only one axis of adjustment is needed. Similarly, the first and second tray guides are not necessarily stationary. For example, they could be manually adjustable. Alternatively, the first and second tray guides could be formed as a single L-shaped piece or completely eliminated as separate components by using one or more of the interior edges of the paper tray as stationary guides.

Figure 6:
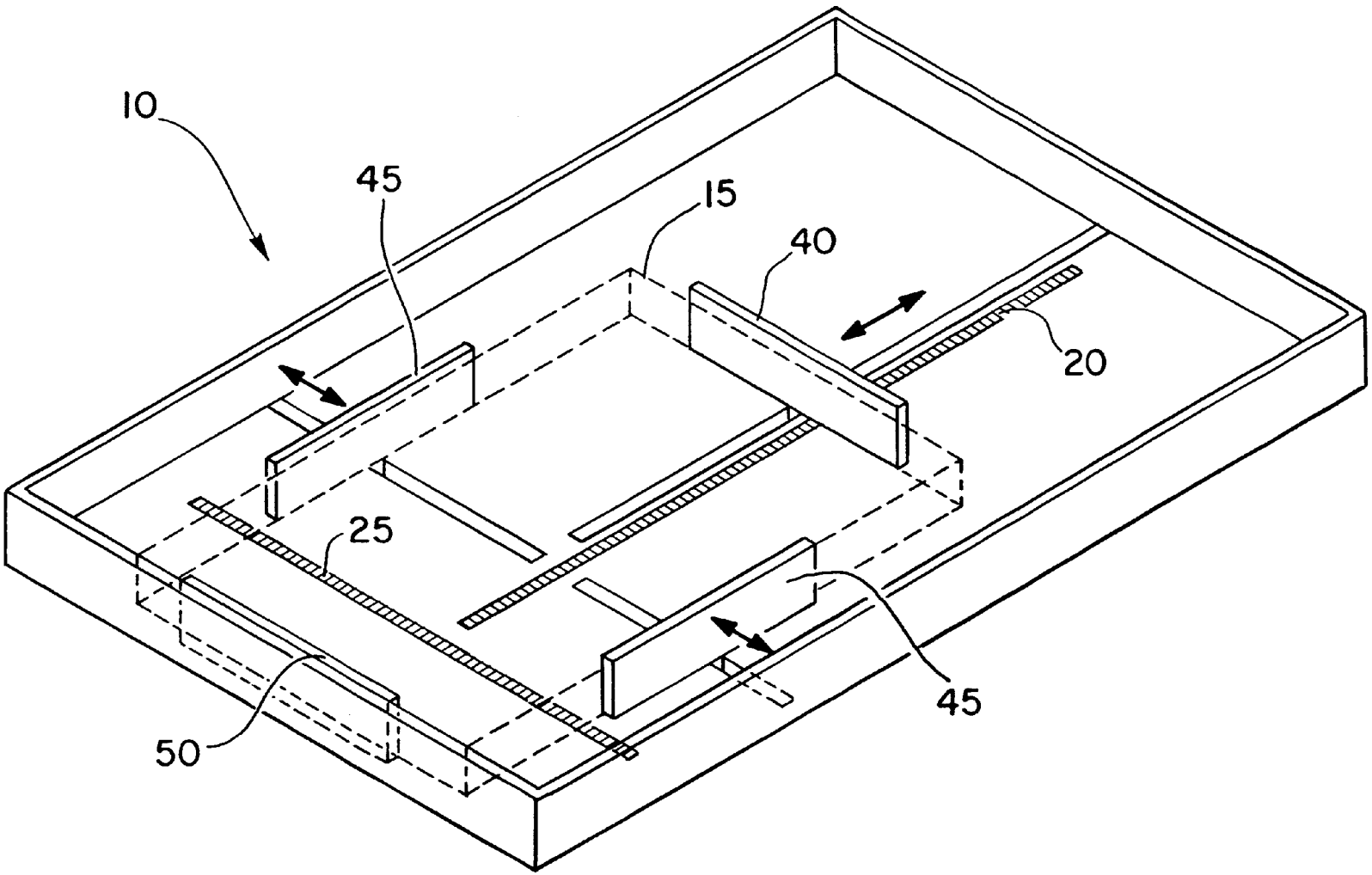
FIG. 6 is a top perspective view of another embodiment of the paper tray 10 with three movable tray guides.

The paper tray 10 could be equipped with more than two movable tray guides, if necessary. For example, three movable tray guides could be used to simultaneously center the media 15 in the paper tray 10 and properly align the stack to be fed into the sheet-fed device, as illustrated in FIG. 6. The photodetector arrays 20, 25 in this embodiment are arranged in a generally T-shaped configuration with both ends of the second photodetector array 25 extending beyond the side edges of the media 15. The controller 30 determines the width of the media 15 from the number of photodetectors in the second array 25 that are masked from the media, and moves both opposing movable guides 45 to corresponding positions to center the media in the paper tray 10. The first photodetector array 20 forms the stem of the T and extends beyond the bottom edge of the media 15. The controller determines the length of the media from the number of photodetectors in the first array 20 that are masked by the media, and moves the third movable guide 40 to its corresponding location. This configuration is well suited for use in conjunction with a sheet-fed device that expects the media to be centered along the leading edge of the paper tray 10.

Figure 5:
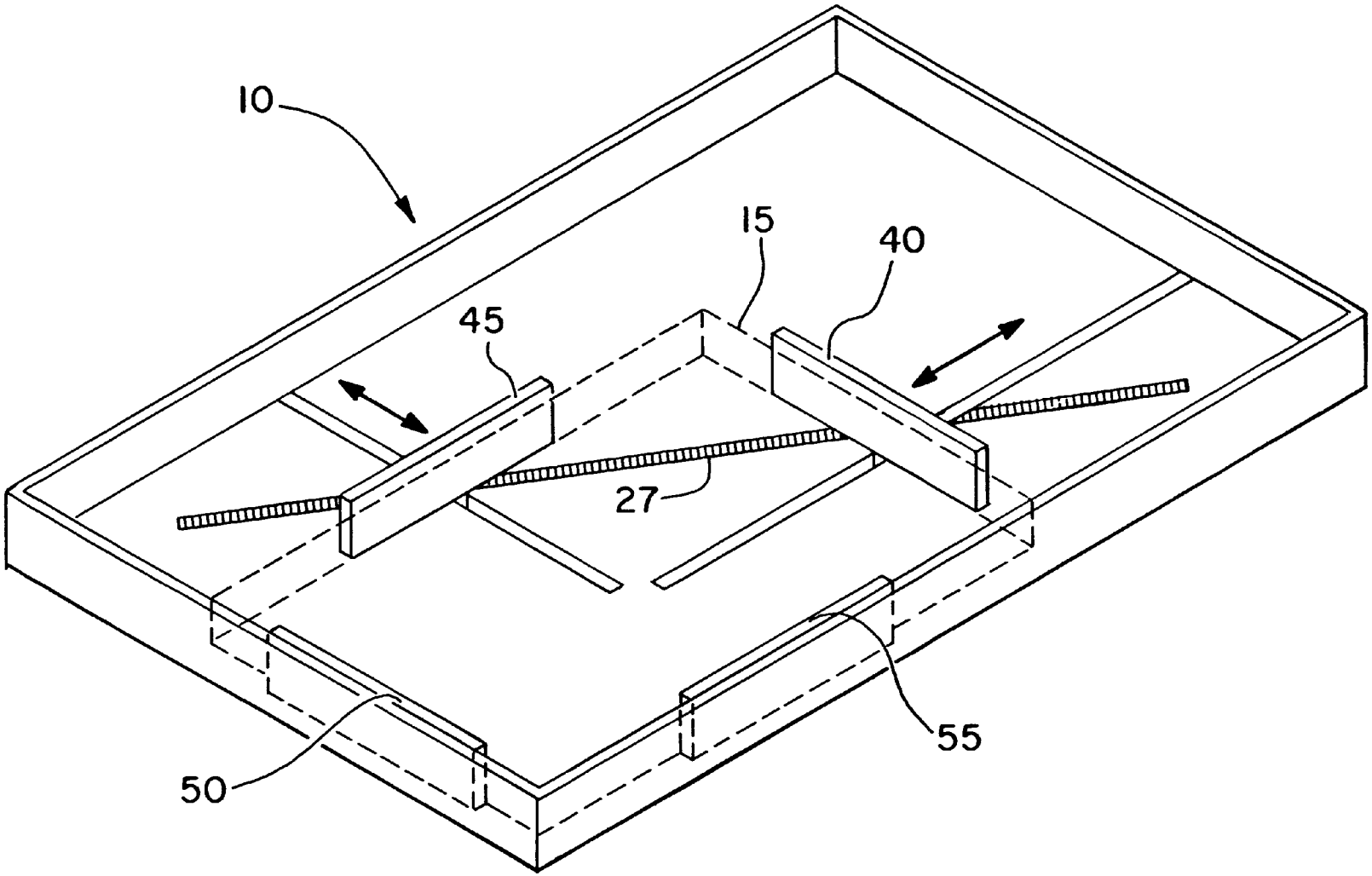
FIG. 5 is a top view of another embodiment of the paper tray 10 using a diagonal array of photodetectors 27.

FIG. 5 is a top view of an another embodiment of the present invention in which the two orthogonal arrays of photodetectors 20 and 25 have been replace with a single diagonal array of photodetectors 27. The central portion of the diagonal array 27 underlies the media 15, but the ends of the diagonal array extend beyond the edges of the media 15 on two orthogonal sides of the stack. This allows the controller 30 to measure both the length and width of the media 15 by monitoring which photodetectors are unmasked on both ends of the diagonal photodetector array 27.

In operation, the paper tray is initially opened by the user. If this can be sensed by the controller 30, it can retract the movable guides to maximize the size of the region for holding media. Alternatively, this feature could be activated if desired by the user by pressing a button on the control panel of the device. A stack of media 15 is then inserted by the user into the paper tray 10 in the region bounded by the guides 40, 45, 50, and 55. The media 15 mask some of the photodetectors in each array 20, 25 from light, while others remain illuminated. The controller 30 monitors which of the photodetectors have been masked and which remain illuminated. Based on this information, the controller 30 can determine the dimensions of the media. The controller 30 then directs the motors 42, 47 to slide the movable tray guides 40, 45 to predetermined positions corresponding to the dimensions of the media 15.

The above disclosure sets forth a number of embodiments of the present invention. Other arrangements or embodiments, not precisely set forth, could be practiced under the teachings of the present invention and as set forth in the following claims.

We claim:

1. A tray for holding a stack of media comprising:

a tray having a support surface for holding a stack of media;

an array of photodetectors on the support surface of the tray;

at least one movable tray guide having a motor controlling the position of the tray guide on the tray; and a controller monitoring which photodetectors in the array of photodetectors are masked by media placed on the tray and thereby determining the size of the media; said controller further directing the tray guide motors to move the tray guides to predetermined positions corresponding to the size of the media.

2. The tray of claim 1 wherein the array of photodetectors comprises two orthogonal arrays of photodetectors.

3. The tray of claim 1 wherein the array of photodetectors comprises a diagonal line of photodetectors.

4. The tray of claim 1 wherein the movable tray guides comprise two orthogonal tray guides positioned to correspond to the length and width of the media, respectively.

5. The tray of claim 4 further comprising two orthogonal stationary tray guides opposing the movable tray guides.

6. The tray of claim 5 wherein the stationary tray guides and movable tray guides define a rectangular region of the tray for holding a stack of media, and wherein the photodetectors arrays extend within the region bounded by the stationary tray guides and movable tray guides.

7. The tray of claim 1 wherein the photodetectors that are not masked by the media are illuminated by ambient light.

8. The tray of claim 1 further comprising a light source illuminating those photodetectors that are not masked by the media.

9. A tray for holding a stack of media comprising:

a tray having a support surface for holding a stack of substantially rectangular media;

a first array of photodetectors extending on the support surface parallel to the length of media placed in the tray;

a second array of photodetectors extending on the support surface parallel to the width of the media placed in the tray, said second array of photodetectors being substantially orthogonal to the first array of photodetectors;

a first movable tray guide having a motor controlling the position of the first tray guide on the tray to accommodate the length of the media;

a second movable tray guide having a motor controlling the position of the second tray guide on the tray to accommodate the width of the media; and a controller monitoring which photodetectors in the first and second arrays of photodetectors are masked by media placed on the tray and thereby determining the length and width of the media; said controller further directing the motor of the first movable tray guide to move the first movable tray guide to a predetermined position corresponding to the length of the media, and directing the motor of the second movable tray guide to move the second movable tray guide to a predetermined position corresponding to the width of the media.

10. The tray of claim 9 further comprising a third tray guide and a fourth tray guide orthogonal to the third tray guide, said third and fourth tray guides opposing the first and second movable tray guides, respectively.

11. The tray of claim 9 wherein the tray guides define a rectangular region of the tray for holding a stack of media, and wherein the first and second photodetectors arrays extend within the region bounded by the tray guides.

12. The tray of claim 9 further comprising a light source illuminating those photodetectors of the first and second arrays of photodetectors that are not masked by the media.

13. The tray of claim 9 wherein those photodetectors of the first and second arrays of photodetectors that are not masked by the media are illuminated by ambient light.

14. A tray for holding a stack of media comprising:

a tray having a support surface for holding a stack of substantially rectangular media;

a first movable tray guide having a motor controlling the position of the first movable tray guide on the tray relative to a first edge of the media;

a second movable tray guide having a motor controlling the position of the second movable tray guide on the tray relative to a fourth edge of the media;

a third tray guide extending parallel to the first movable tray guide to support a third edge of the media;

a fourth tray guide extending parallel to the second tray guide to support a fourth edge of the media, said fourth tray guide being orthogonal to the third tray guide; and a first array of photodetectors extending on the support surface parallel to, and between the first and third tray guides with at least a portion of the first array of photodetectors underlying the media;

a second array of photodetectors extending on the support surface parallel to, and between the second and fourth tray guides with at least a portion of the second array of photodetectors underlying the media;

a controller monitoring which photodetectors in the first and second arrays of photodetectors are masked by media placed on the tray and thereby determining the size of the media, said controller further directing the motors of the first and second movable tray guides to move the first and second tray guides to predetermined positions corresponding to the size of the media.

15. The tray of claim 14 wherein the tray guides define a rectangular region of the tray for holding a stack of media, and wherein the first and second photodetectors arrays extend within the region bounded by the tray guides.

16. The tray of claim 14 further comprising a light source illuminating those photodetectors of the first and second arrays of photodetectors that are not masked by the media.

17. The tray of claim 14 wherein those photodetectors of the first and second arrays of photodetectors that are not masked by the media are illuminated by ambient light.

* * * * *